US008173078B2

(12) United States Patent
Yao et al.

(10) Patent No.: US 8,173,078 B2
(45) Date of Patent: May 8, 2012

(54) GRAVITY-DRIVEN MICROPUMP

(75) Inventors: Nan-Kuang Yao, Taoyuan (TW); Jhy-Wen Wu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 2040 days.

(21) Appl. No.: 10/835,101

(22) Filed: Apr. 28, 2004

(65) Prior Publication Data

US 2005/0244283 A1 Nov. 3, 2005

(51) Int. Cl.
*B01L 3/00* (2006.01)

(52) U.S. Cl. ..... 422/502; 422/501; 422/500

(58) Field of Classification Search ..... 422/100, 422/101, 502, 501
See application file for complete search history.

(56) References Cited

U.S. PATENT DOCUMENTS 5,225,163 A * 7/1993 Andrews ..... 422/61
6,010,316 A 1/2000 Haller et al. ..... 417/322
6,521,188 B1 * 2/2003 Webster ..... 422/100
6,602,472 B1 * 8/2003 Zimmermann et al. ..... 422/100
2003/0196900 A1 10/2003 Chuang et al. ..... 204/600

FOREIGN PATENT DOCUMENTS

JP 2004501342 1/2004
WO 0126813 A2 4/2001

* cited by examiner

*Primary Examiner* — Natalia Levkovich
(74) *Attorney, Agent, or Firm* — Lin & Associates IP, Inc.

(57) ABSTRACT

A microfluidic chip with a built-in gravity-driven micropump is provided. The gravity-driven micropump comprises a winding channel, an inert fluidic material placed inside the winding channel, and a suction channel that links the winding channel to the microfluidic chip. The winding channel is for the inert fluidic material to flow in. A fixed volume of high density, inert fluidic material is placed in the winding channel to act as a micropump in the bio chip. When the microfluidic chip is placed in a declining or standing position, the inert fluidic material flows along the winding channel due to the gravity. The invention provides a simple, convenient, and robust microfluid pumping source. With the built-in micropump, this invention is free-of-pollution and saves the manufacturing cost for the pipe link between the bio chip and peripheral devices.

5 Claims, 6 Drawing Sheets

GRAVITY-DRIVEN MICROPUMP

FIELD OF THE INVENTION

The present invention generally relates to micropumps, and more specifically to a gravity-driven micropump using the flow of high-density inert material driven by gravity. It can be applied in Bio Micro-Electro-Mechanical-Systems (Bio-MEMS).

BACKGROUND OF THE INVENTION

Micropumps are widely used in the Bio-MEMS technology, such as microfluidic sensors, microfluidic analysis chips, or microfluidic cellular chips. Take microfluidic analysis chip as an example. Micropumps can be used in sample pre-processing, mixing, transmission, isolation, and detection. There are numerous methods to fabricate a micropump. These methods are generally categorized as: bubble pumps, membrane pumps (compressed-air-driven, thermal-pressure-driven, piezoelectric-driven, static-electric-driven, dual-metal-driven, shape memory alloy (SMA) driven, and electromagnetic-driven), diffusion pumps, rotation pumps, electro-fluidic pumps, and electro-osmotic pumps.

In 1988, Van Lintel et. al. used piezoelectric material-driven membrane to fabricate micropumps. In U.S. Pat. No. 6,010,316, Haller et. al. teaches a micropump as shown in FIG. 1, in which a fluid is pumped by the interaction of longitude acoustic waves and the fluid in the microchannel. The micropump has an acoustical transducer 105 responsive to a high-frequency input and directing a longitudinal acoustic wave into the channel 106 which induces a pressure gradient. The fluid in the channel flows in the direction of travel of the acoustic wave in the channel. In U.S. Pat. No. 0,196,900, Chuang et. al. discloses a hydrogel-driven micropump using electrophoresis to drive charged ions to move under the high electro-pressure. In 2000, Wallace used an electro-osmotic pump to drive the flow of the fluid by external driving voltage and the distribution of fluid charges. WO 03/008102 disclosed a microfluidic gravity pump with constant flow rate utilizing the height difference between connected two fluid containers, 401 and 402, as shown in FIG. 2.

Prior art micropumps are numerous. However, the primary object of a micropump is to provide a driving force for the microfluid in a microchannel to flow in a specified direction. Thereby, it is important that a practical micropump should be low in energy-consumption, low in manufacturing cost and free-of-pollution.

SUMMARY OF THE INVENTION

This invention has been made to achieve the advantages of a practical micropump. The primary object is to provide a gravity-driven micropump for employing in microfluidic chips. The gravity-driven micropump comprises a channel, an inert fluidic material placed inside the channel, and a suction channel that links the channel to the microfluidic chip. The significant feature of the invention is it includes a channel for the inert fluidic material to flow in.

According to the invention, some advantages can be achieved when the channel is a winding channel. These advantages include: (1) the release of potential can be gradual, (2) prolonging the length of flow path, and (3) using turning points as buffer to control the flow rate of the inert fluidic material. The inert fluidic material used in the invention is a high-density material, such as Ficoll, and PerFluoroChemicals.

It is another object of the invention to provide a gravity-driven micropump which does not use the mass of the reactants as the source of driving force. This avoids interference to the gravity-driven effect due to the variation of density and/or viscosity after the reactants go through a bio reaction.

It is still another object of the invention to provide a microfluidic chip including a gravity-driven micropump as mentioned above. The microfluidic chip comprises at least one reactant chamber, at least one air inlet channel connected to the reactant chamber, a reaction chamber connected to the reactant chamber, a waste fluid chamber connected to the reaction chamber, and the gravity-driven micropump connected to the waste fluid chamber.

According to the invention, when the microfluidic chip is placed in a declining or standing position, the inert fluidic material flows along the channel due to the gravity. The potential released by the flow of the inert fluidic material driven by gravity provides the driving force to conduct the reactants inside the chip into the reaction chamber of the microfluidic chip. The invention places a fixed volume of high density, inert fluidic material in the microfluidic chip.

In summary, this invention provides a microfluidic chip with a built-in gravity-driven micropump. The main feature of the micropump is it comprises a channel for the inert fluidic material to flow in. It places a fixed volume of high density, inert fluidic material in the chip. As such, this invention provides a simple, convenient, and robust microfluid pumping source. With the built-in micropump, this invention is free-of-pollution and saves the manufacturing cost for the pipe link between the microfluidic chip and peripheral devices.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
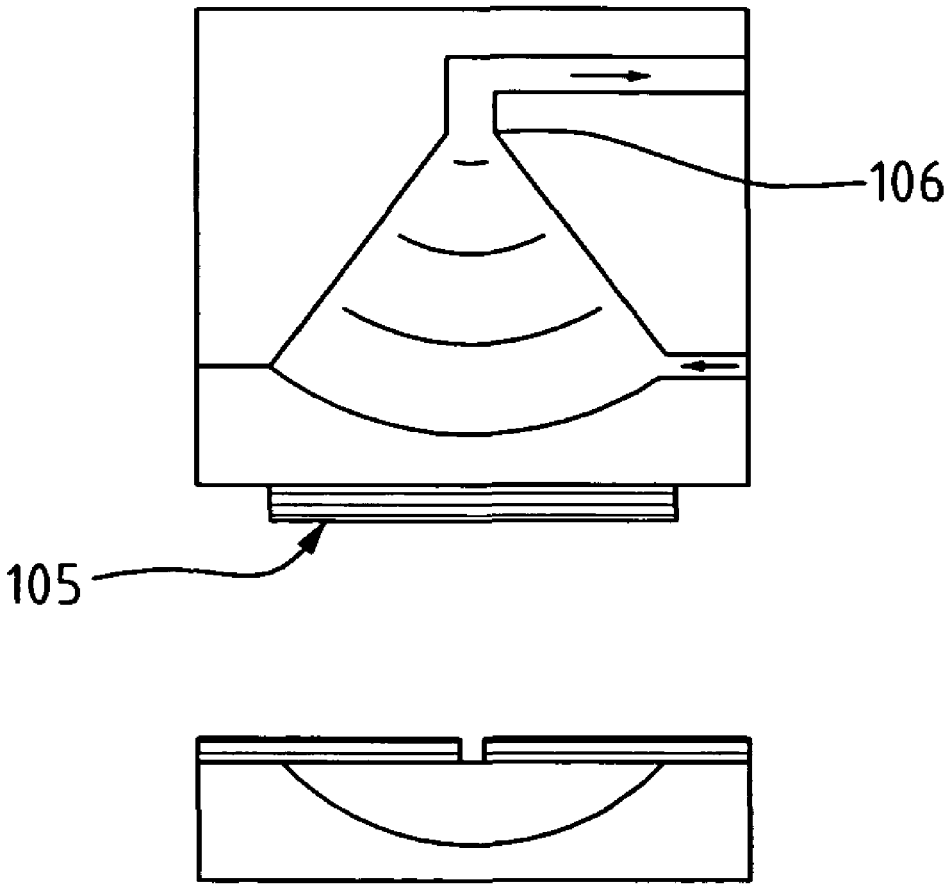
FIG. 1 (PRIOR ART)
FIG. 1 shows a conventional micropump, in which a fluid is pumped by the interaction of longitude acoustic waves and the fluid in the microchannel.
Figure 2:
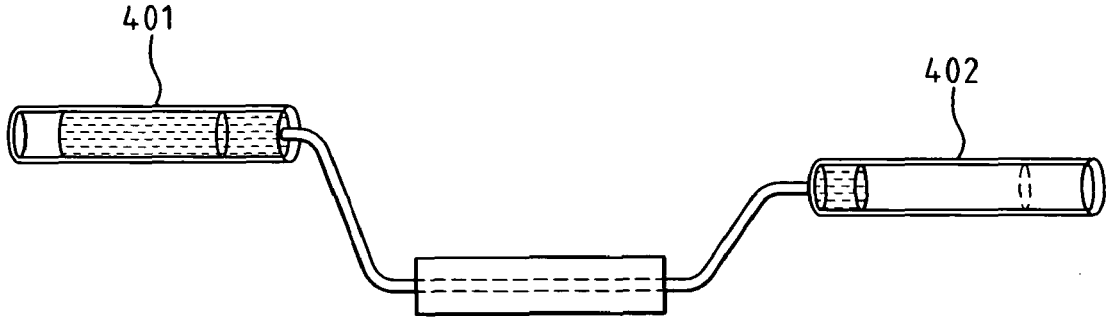
FIG. 2 (PRIOR ART)
FIG. 2 shows a conventional microfluidic gravity pump with constant flow rate.
Figure 3:
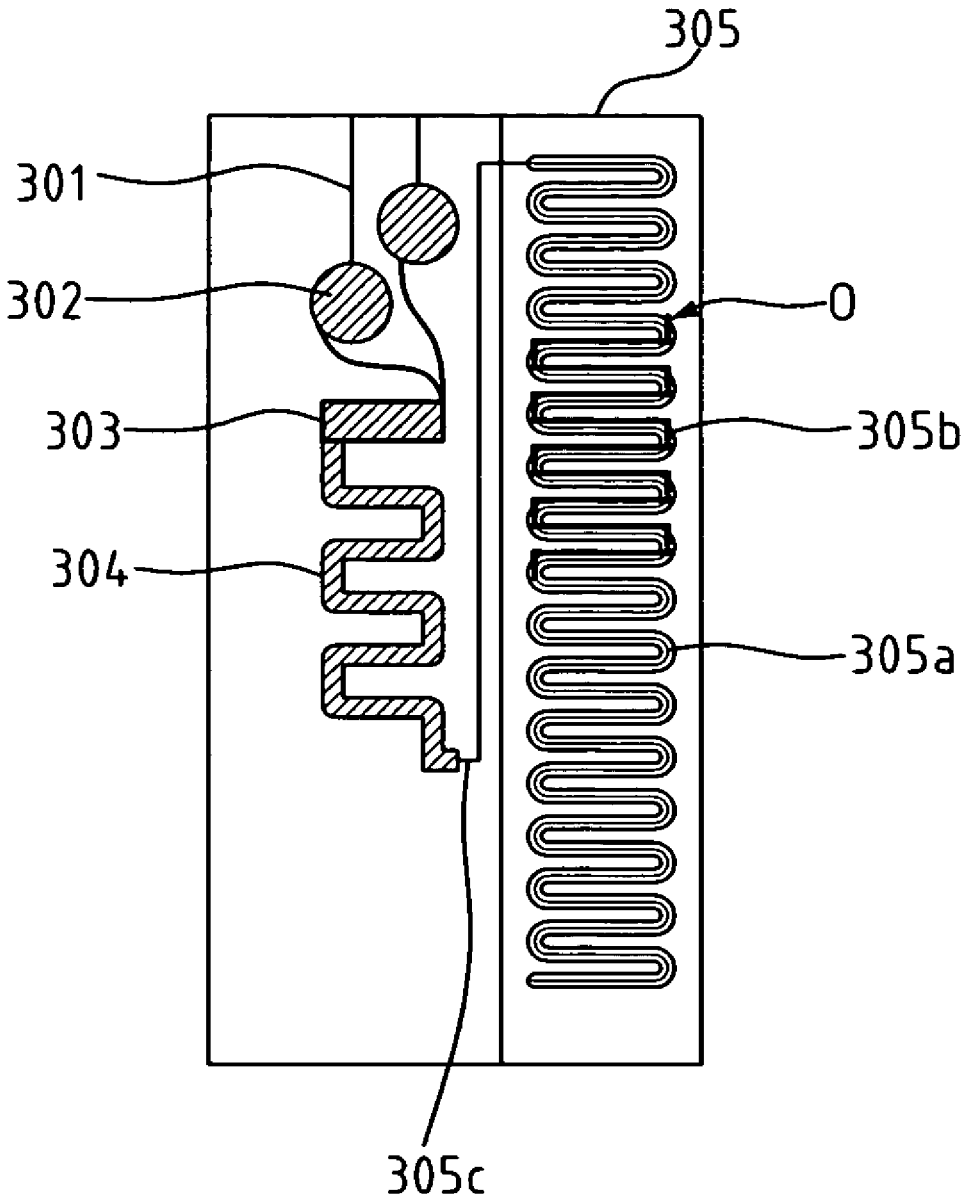
FIG. 3 shows a schematic view of the structure of a microfluidic chip of the present invention.

FIG. 3 shows a schematic view of a structure of a microfluidic chip according to the present invention. As shown in FIG. 3, the microfluidic chip 300 includes at least one air inlet channel 301, at least one reactant chamber 302, a reaction chamber 303, a waste fluid chamber 304, and a built-in micropump 305. The micropump 305 includes a channel 305*a*, a high density inert material 305*b* inside the channel 305*a*, and a suction channel 305*c*. The air inlet channel 301 is connected to each reactant chamber 302. Reactant chamber 302 is used for storing the reactant (not shown) before the reaction. At the bottom of the reactant chamber 302 is a channel through which the reactant can flow into reaction chamber 303, where the reaction takes place. The waste fluid chamber 304 is connected to reaction chamber at one end and connected to the suction channel 305*c* at the other end. The waste fluid chamber 304 is to store the fluids after the reaction. The suction channel 305*c* is connected to the waste fluid chamber 304 at one end and to the channel 305*a* at the other end.

According to the invention, a specified volume of the high density inert material 305*b* is placed in the channel 305*a* which is a pressure-control channel. With reference to FIG. 3, the working process for the invention is described as follows. Initially, the inert fluid material 305*b* is placed in the channel 305*a*, and the air inlet channels 301 are all sealed (not shown) so that the air will not come in. When the microfluidic chip 300 is placed in the standing or declining position and the seal of air inlet channels are removed, the inert fluidic material 305*b* starts to flow down along the channel 305*a* due to the gravity. This creates a negative pressure at the top of channel. The negative pressure creates a suction force in the suction channel 305*c*, through the waste fluid chamber 304 and the reaction chamber 303. The aforementioned suction force drives the reactant in the reactant chamber 302 into the reaction chamber 303. The reaction arises while the reactants flow through the reaction chamber, then further flow into the waste fluid chamber 304.

As mentioned before, some advantages can be achieved when the channel 305*a* is a winding channel. For simplicy, the channel 305*a* in the embodiment of FIG. 3 is illustrated as a winding channel. As shown in FIG. 3, the winding channel 305*a* may further include a plurality of turning points 0. The turning points serve as regulators to slow down the flow of the inert fluid material 305*b* so that the flow can be controlled at a constant rate. The winding channel is designed to achieve the following objectives: (1) the release of potential can be gradual to avoid energy consumption in negative gravity direction, (2) prolonging the length of flow path to increase the total pumping volume of the micropump 305, and (3) using a plurality of turning points as buffer to control the flow rate of the inert fluidic material. The inert fluidic material used in the invention is a high-density material, such as Ficoll, and PerFluoroChemicals.

A number of factors will affect the amount of the driving force and total reaction time for the reactants. These factors include the density and the viscosity of the inert fluidic material, the friction between the inert fluidic material and the winding channel, the form and the length of the winding channel. Therefore, the aforementioned factors can be used as control parameters in designing the microfluidic chip of the present invention.

Figure 4:
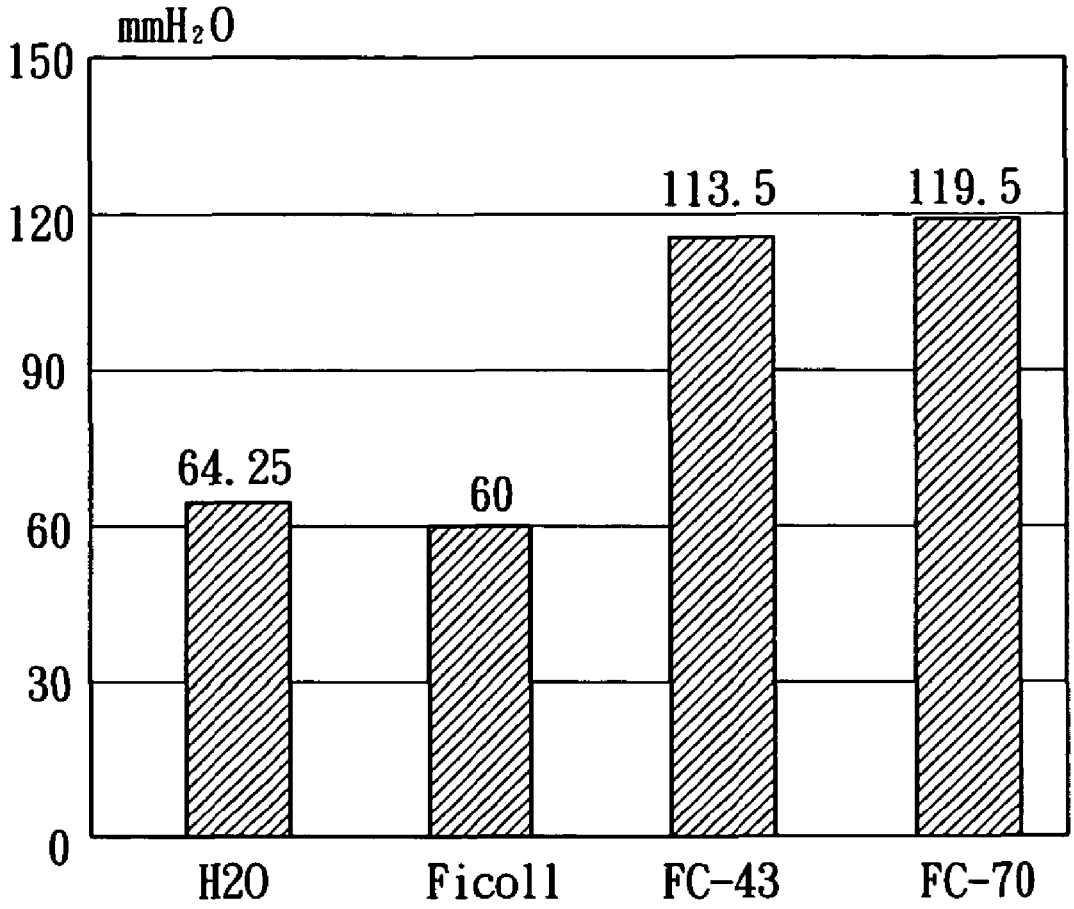
FIG. 4 shows an experimental result illustrating different fluidic materials can be selected for different task requirements according to the present invention.
Figure 5:
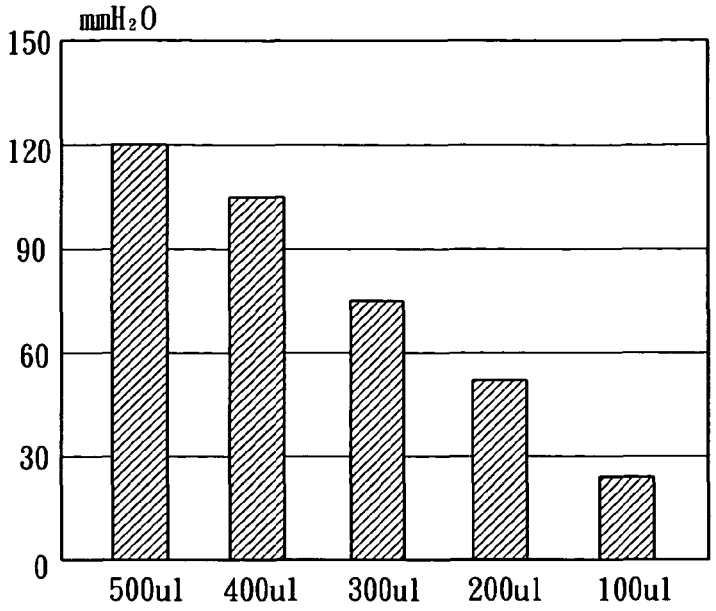
FIG. 5 shows the results of an experiment using different volumes of inert fluidic materials.

FIG. 4 shows an experimental result illustrating different fluidic materials can be selected for different task requirements according to the present invention. Different fluidic materials are placed into the winding channel to conduct experiments for testing the total driving force. The material used includes water (density=1), Ficoll (density=1.11), PerFluoroChemicals FC-43 (density=1.85), and PerFluoroChemicals FC-70 (density=1.94). The experimental results are shown in the histogram of FIG. 5, in which the height of the water that is pumped by the gravity-driven fluid material is recorded (unit: $mmH_2O$). The results indicate that the 60 mm, 113.5 mm, and 119.5 mm of water are pumped by 500 ul each of the Ficoll, FC-43, and FC-70, respectively.

FIG. 5 shows the results of another experiment using different volumes of PerFluoroChemicals FC-70. The results show that when 500 ul, 400 ul, 300 ul, 200 ul, and 100 ul PerFluoroChemicals FC-70 are used as the inert fluidic material in the invention, the height of the water that is pumped by the gravity-driven inert fluidic material. The results indicate that the larger the volume of the inert fluidic material, the higher the water can be pumped, and the relation is near linear.

Figure 6:
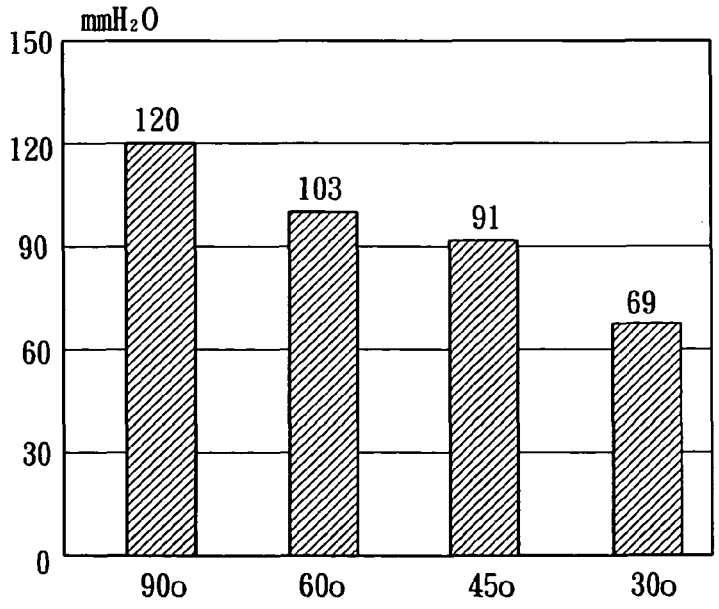
FIG. 6 shows the results of an experiment using different declining angle of the embodiment of the present invention.
Figure 7:
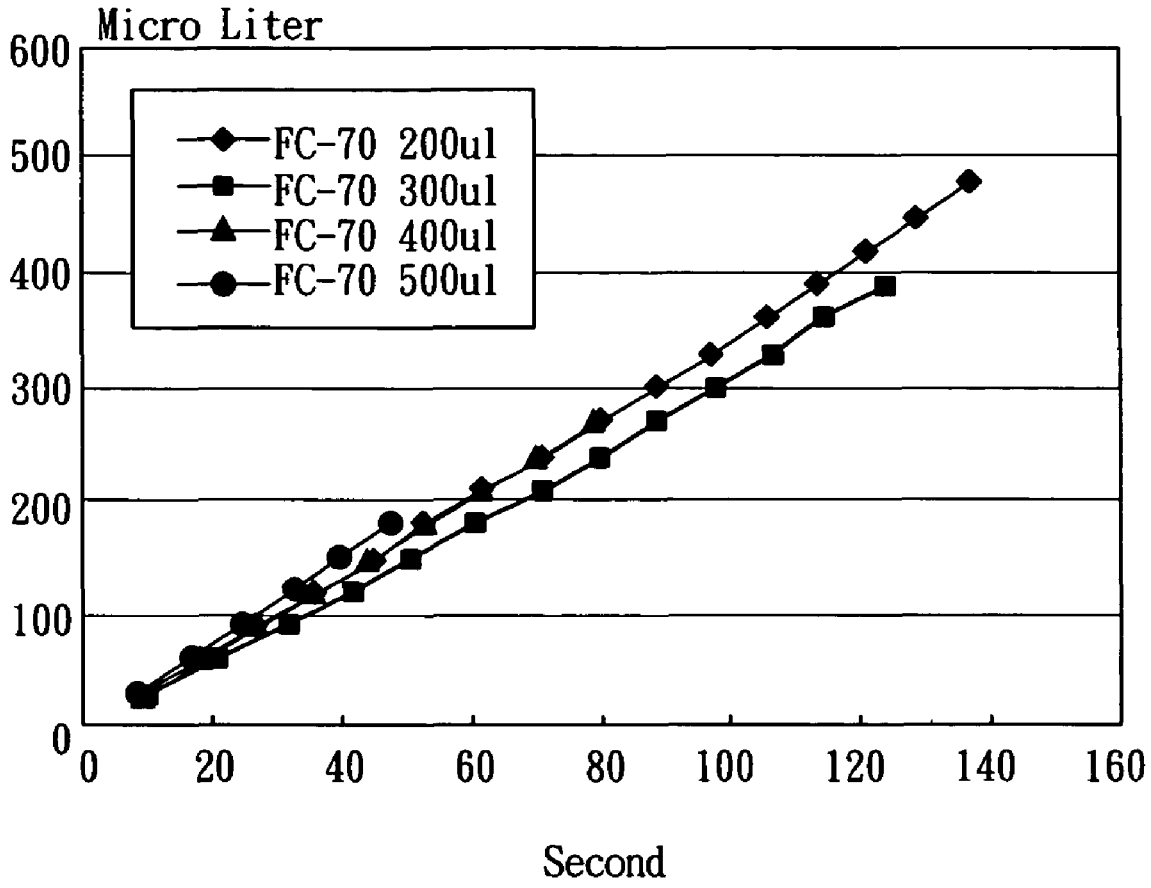
FIG. 7 shows the results of an experiment using different volumes of inert fluidic materials to measure the flow rate.

FIG. 6 shows the results of another experiment using the declining position as a flow control factor. The horizontal axis represents declining angle (unit: degree) of the microfluidic chip, and the vertical axis represents the height of the water that is pumped by the gravity-driven inert fluidic material. Various angles of declining positions are used, and the water that can be pumped is measured. The results show that a near linear relation exists between the declining angle and the height of the pumped water. FIG. 6 and FIG. 7 demonstrate that volume of the inert fluidic material and declining angle of the microfluidic chip can be used as the control parameters for the invention.

FIG. 7 shows the results of another experiment using different volumes of FC-70 as the inert fluidic material to measure the flow rate of pumped water in a horizontal tube which is connected with the micropump. The horizontal axis represents time (unit: second), and the vertical axis represents the pumping volume of water in the horizontal tube (unit: micro liter). Therefore, the slope of the line in FIG. 7 indicates the flow rate. The experiment uses 200 ul, 300 ul, 400 ul, and 500 ul FC-70 to pump the water, and the results in FIG. 8 show the increase of the pumping volume is stable with small standard deviation (0.27 ul/s). That is, the experiment shows the constant flow rate according to the present invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A gravity-driven micropump for employing in a microfluidic chip, said gravity-driven micropump comprising:

at least one air inlet channel;

at least one reactant chamber for storing a reactant, said reactant chamber having a top end connected to said air inlet channel;

a reaction chamber having a top end connected to a bottom end of said reactant chamber;

a waste fluid chamber having a top end connected to a bottom end of said reaction chamber;

a pressure-control channel containing a pressure-control fluid inside a section between a first end and a second end of said pressure-control channel for controlling pressure in said pressure-control channel, said pressure-control fluid flowing from said section towards said second end by gravity force when said micropump is oriented by a user to position said first end higher than said second end; and a connection channel having a first end connected to a bottom end of said waste fluid chamber and a second end linked to said first end of said pressure-control channel;

wherein when said pressure-control fluid flows towards said second end of said pressure-control channel, a negative pressure is created inside said connection channel, said waste fluid chamber and said reaction chamber to drive said reactant from said reactant chamber to flow through said reaction chamber into said waste fluid chamber.

2. The micropump as claimed in claim 1, wherein said pressure-control channel is a winding channel.

3. The micropump as claimed in claim 1, wherein said pressure-control fluid has a density higher than the density of water.

4. The micropump as claimed in claim 1, wherein said pressure-control fluid is initially placed near said first end of said pressure-control channel.

5. The micropump as claimed in claim 2, wherein said winding channel includes a plurality of turning points.

* * * * *